US011515086B2

(12) United States Patent
Sako et al.

(10) Patent No.: US 11,515,086 B2
(45) Date of Patent: Nov. 29, 2022

(54) METHOD FOR MANUFACTURING SINTERED MAGNET

(71) Applicant: Nissan Motor Co., Ltd., Yokohama (JP)

(72) Inventors: Michihiro Sako, Chigasaki (JP); Shinichirou Fujikawa, Yokohama (JP); Akihiko Ikeda, Yokohama (JP); Hiroki Matsunae, Yokohama (JP); Takashi Furuya, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 699 days.

(21) Appl. No.: 14/408,983

(22) PCT Filed: Jun. 26, 2013

(86) PCT No.: PCT/JP2013/067499
§ 371 (c)(1),
(2) Date: Dec. 18, 2014

(87) PCT Pub. No.: WO2014/010418
PCT Pub. Date: Jan. 16, 2014

(65) Prior Publication Data

US 2015/0206654 A1 Jul. 23, 2015

(30) Foreign Application Priority Data

Jul. 12, 2012 (JP) ..... JP2012-156982

(51) Int. Cl.
*H01F 41/02* (2006.01)
*C22C 38/00* (2006.01)
(Continued)

(52) U.S. Cl.
CPC ..... *H01F 41/0266* (2013.01); *B22F 3/12* (2013.01); *B22F 3/164* (2013.01); *B22F 3/24* (2013.01);
(Continued)

(58) Field of Classification Search
CPC ..... B22F 2003/248; B22F 2998/10; B22F 3/164; B22F 3/02; B22F 3/10; B22F 3/12;
(Continued)

(56) References Cited

U.S. PATENT DOCUMENTS 3,892,598 A * 7/1975 Martin ..... H01F 1/0557 148/103
4,695,333 A * 9/1987 Inoue ..... H01F 1/04 148/306
(Continued)

FOREIGN PATENT DOCUMENTS

CN 102576589 A 7/2012
JP S55122823 * 9/1980
(Continued)

OTHER PUBLICATIONS

Hirota, K. et al. "Coercivity enhancement by the grain boundary diffusion process to Nd—Fe—B sintered magnets." 2006. Transaction on magnetics. 42. p. 2909-2911. (Year: 2006).*

*Primary Examiner* — Nicholas A Wang
(74) *Attorney, Agent, or Firm* — Global IP Counselors, LLP

(57) ABSTRACT

A method for manufacturing a sintered magnet includes molding a green compact formed by compacting a magnet powder by press-molding the magnet powder, the green compact forming an R—Fe—B based sintered magnet having Nd as the principal component and containing a rare earth element R, sintering the green compact by heating to a sintering temperature, so as to mold a sintered magnet,
(Continued)

pressure molding the sintered magnet by heating to a temperature not exceeding the sintering temperature, so as to correct dimensions of the sintered magnet, and adjusting the texture of the sintered magnet by aging heat treatment using heated atmosphere produced when correcting the dimensions of the sintered magnet at a temperature not exceeding the temperature during the pressure molding.

20 Claims, 15 Drawing Sheets

(51) Int. Cl.

| | |
|---|---|
| ***H01F 1/057*** | (2006.01) |
| ***C21D 1/26*** | (2006.01) |
| ***B22F 3/16*** | (2006.01) |
| ***B22F 3/12*** | (2006.01) |
| ***B22F 3/24*** | (2006.01) |
| ***B22F 3/26*** | (2006.01) |

(52) U.S. Cl.
CPC ..... *B22F 3/26* (2013.01); *C21D 1/26* (2013.01); *C22C 38/002* (2013.01); *C22C 38/005* (2013.01); *H01F 1/0577* (2013.01); *H01F 41/0293* (2013.01); *B22F 2003/248* (2013.01); *B22F 2998/10* (2013.01); *C21D 2201/00* (2013.01)

(58) Field of Classification Search
CPC ..... B22F 3/24; B22F 3/26; C21D 1/26; C21D 2201/00; H01F 1/0577; H01F 41/0266; H01F 41/0293; C22C 38/002; C22C 38/005
See application file for complete search history.

(56) References Cited

U.S. PATENT DOCUMENTS

| | | | | |
|---|---|---|---|---|
| 2006/0006210 | A1* | 1/2006 | Nonomura ..... | G05D 23/1951 228/101 |
| 2006/0144477 | A1* | 7/2006 | Cox ..... | C22F 1/10 148/522 |

FOREIGN PATENT DOCUMENTS

| | | | | |
|---|---|---|---|---|
| JP | 60-77961 | A | | 5/1985 |
| JP | 62-30846 | A | | 2/1987 |
| JP | S62030846 | | * | 2/1987 |
| JP | 62-262405 | A | | 11/1987 |
| JP | 1-270210 | A | | 10/1989 |
| JP | 2005-294558 | A | | 10/2005 |
| JP | 2007-88206 | A | | 4/2007 |
| JP | 2007-258377 | A | | 10/2007 |
| JP | 2008-300853 | A | | 11/2008 |
| JP | 4329318 | B | | 6/2009 |
| JP | 2010-74084 | A | | 4/2010 |
| JP | 2012-23197 | A | | 2/2012 |
| JP | 2013-98485 | A | | 5/2013 |

* cited by examiner

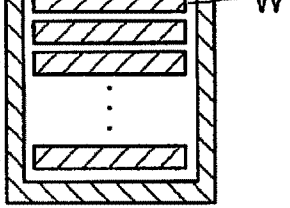
FIG. 6D
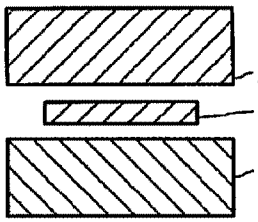
FIG. 6C
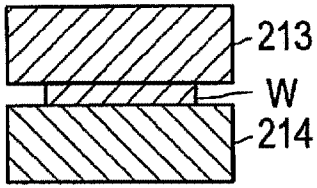
FIG. 6B
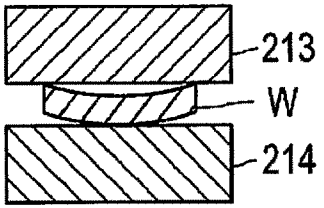
FIG. 6A
FIG. 6E
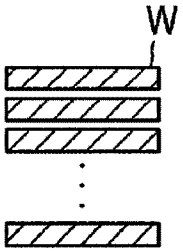
FIG. 6F

METHOD FOR MANUFACTURING SINTERED MAGNET

CROSS-REFERENCE TO RELATED APPLICATIONS

This application is a U.S. National stage application of International Application No. PCT/JP2013/0647499 filed, Jun. 26, 2013, which claims priority to Japanese Patent Application No. 2012-156982 filed in Japan on Jul. 12, 2012, the contents of each of which are hereby incorporated herein by reference.

BACKGROUND

Field of the Invention

The present invention relates to a method for manufacturing sintered magnets used in high-performance motors and the like.

Background Information

Nd—Fe—B based sintered magnets are widely employed as permanent magnets used in motors of hybrid automobiles and the like, and due to their exceptional magnetic characteristics, demand is expected to increase in the future as well.

The conventional manufacturing method for Nd—Fe—B based sintered magnets involves melting starting materials, such as Nd, Fe, B, and the like, in a vacuum or in an argon gas atmosphere, and then using a jaw crusher and a jet mill or the like to coarsely pulverize and finely pulverize the melted starting material. The pulverized starting material is then molded to a predetermined shape within a magnetic field, sintered and heat treated, subjected to a slicing process or grinding process using a slicer or grinding machine, and after carrying out surface treatment and inspection, is magnetized.

According to Japanese Patent Publication 4329318, in order to minimize precipitation of ferromagnetic compounds, which tends to occur in cases in which transition metals such as Co or the like are added to an Nd—Fe—B based sintered magnet, and to improve the retention force, which is one of the characteristics of a magnet, a powder of a rapidly quenched alloy is sintered at a temperature of 1,000° C. to 1,110° C., forming a sinter. The sinter is then cooled to bring the temperature to below 400° C., and is then reheated to increase it to a temperature of 400° C.-900° C., cooled at a predetermined rate, subjected to heat treatment, and after reaching room temperature, is subjected to a grinding process or the like.

SUMMARY

According to Japanese Patent Publication 4329318, by carrying out heating and cooling steps in the aforedescribed manner, the constitution of the grain boundary phase of the sinter is transformed to a structure in which a non-magnetic crystal part is present in an area surrounded by an amorphous layer section, and the retention force of the magnet can be improved. However, when cooling to 400° C. or below is followed by reheating to about 900° C., energy is consumed unnecessarily, as compared with the case of no reheating, and there is a commensurate increase in cost.

Moreover, drastically changing the temperature of the sinter imposes a high thermal load on structures of the apparatus used for heating and cooling, which shortens the lifetime of the apparatus, and leads to increased capital equipment spending. Further, with methods such as that in Japanese Patent Publication 4329318, in which a grinding process is conducted on a material after having passed through a sintering step, metals, including rare earths such as Nd and Dy, contained in the sintered magnet are partially ground away and are not used in the final product, leading to the problem of a poor yield ratio of material.

The present invention is intended to solve the problem mentioned above, and has as an object to provide a method for manufacturing a sintered magnet, with which energy may be used more efficiently from the time of the sintering step to the aging heat treatment step, and with which the yield ratio of material is improved.

According to the method for manufacturing a sintered magnet of the present invention by which the aforedescribed object is achieved, first, a magnet powder for forming an R—Fe—B based sintered magnet having Nd as the principal component and containing a rare earth element R is press-molded, and a green compact formed by compacting the magnet powder is molded. Next, the green compact is sintered in a heated atmosphere heated to sintering temperature, and a sintered magnet is formed. Then, under conditions of heating to a temperature not exceeding the sintering temperature, the dimensions of the sintered magnet are corrected through pressure molding, while utilizing the heated atmosphere produced during dimension correction to carry out aging heat treatment to adjust the texture of the sintered magnet.

BRIEF DESCRIPTION OF THE DRAWINGS

Referring now to the attached drawings which form a part of this original disclosure.

FIGS. 6A-F are schematic views describing the sintered magnet manufacturing method according to a second embodiment of the present invention.

DETAILED DESCRIPTION OF EMBODIMENTS

Figure 1:
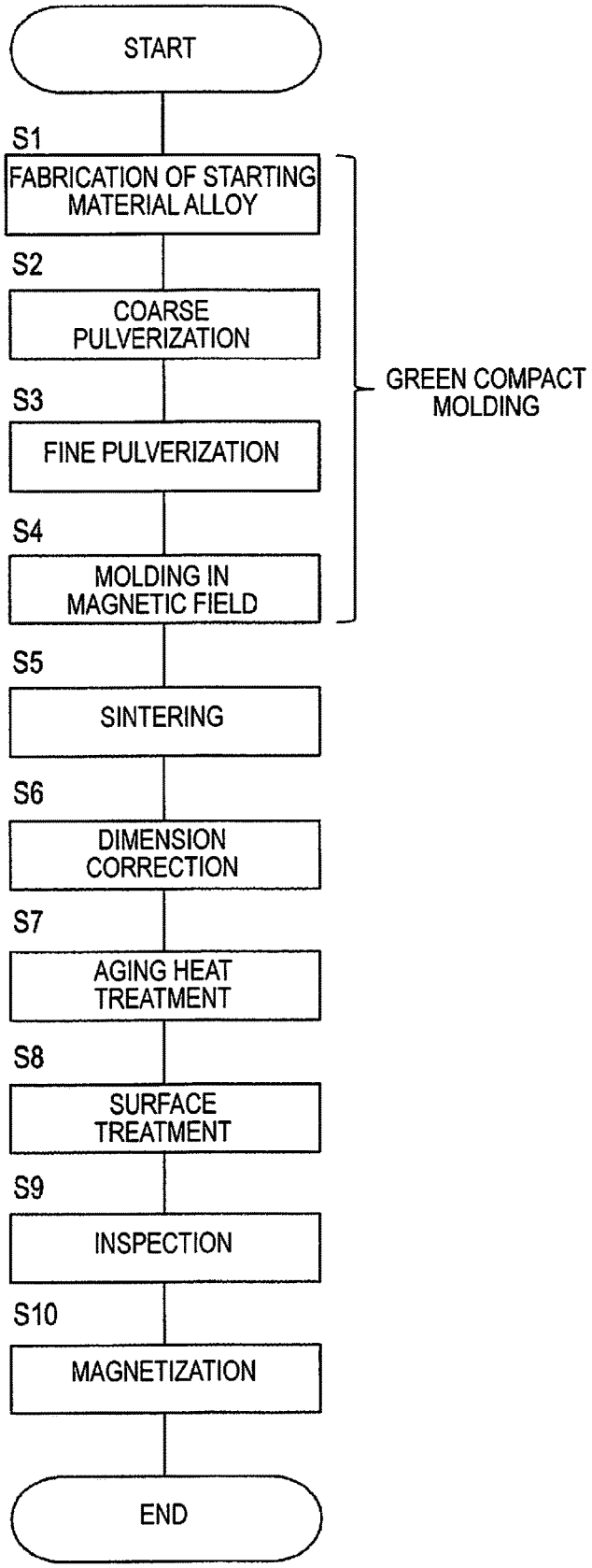
FIG. 1 is a flowchart showing the method for manufacturing a sintered magnet according to a first embodiment of the present invention.

The embodiments of the present invention are described below, while making reference to the appended drawings. The technical scope disclosed in the claims, and the definitions of terms, are not limited to the disclosure hereinbelow. In some cases, the proportions of dimensions in the drawings differ from actual proportions, having been exaggerated for convenience in description.

First Embodiment

FIG. 1 is a flowchart showing the method for manufacturing a sintered magnet according to a first embodiment of the present invention. The R—Fe—B based sintered magnet of the present embodiment is manufactured through the steps of fabrication of a starting material alloy (step S1), coarse pulverization (step S2), fine pulverization (step S3), molding in a magnetic field (step S4), sintering (step S5), dimension correction (step S6), aging heat treatment (step S7), surface treatment (step S8), inspection (step S9), and magnetization (step S10).

Fabrication of the starting material alloy is carried out in a vacuum or an inert gas atmosphere, by a strip casting method or other molten process (step S1). The sintered magnet according to the present embodiment has a main phase of $Nd_2Fe_{14}B$, into which Dy, Tb, Pr or the like have been added, as appropriate, to the Nd. By adding the aforementioned rare earth metals to the Nd main component, the retention force of the sintered magnet can be improved.

A jaw crusher, Braun mill, or the like is employed to coarsely pulverize the fabricated starting material alloy to a particle size on the order of several hundred μm (step S2). The coarsely pulverized alloy is finely pulverized to a particle size of about 3-5 μm by a jet mill or the like (step S3). High coercive force can be obtained in particular, by bringing the particle size to 3-4 μm in the fine pulverization step, and it is therefore preferable to do so.

Next, the finely pulverized magnetic material is molded in a magnetic field, and a green compact is obtained (step S4). The green compact can be made employing various methods such as a parallel magnetic field molding process, a perpendicular magnetic field molding process, or the like. In the present embodiment, the steps from fabrication of the starting material alloy to molding in a magnetic field are designated collectively as green compact molding.

The green compact molded in the magnetic field is sintered in a vacuum or in a non-oxidizing state, and an R—Fe—B based sintered magnet is obtained (step S5). The sintering temperature will vary somewhat depending on the material composition, the pulverization method, and the particle size of the green compact, but is on the order of 900° C.-1,100° C.

Figures 2A, 2B, 2C, 2D:
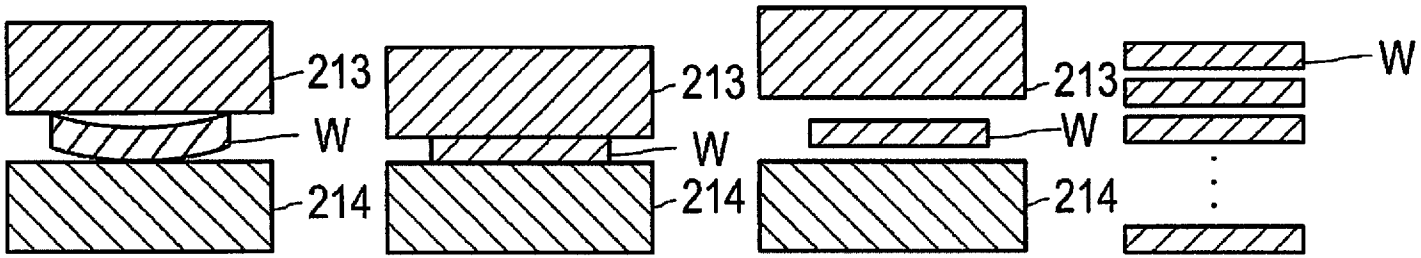
FIGS. 2A-D are schematic views describing the sintered magnet manufacturing method.
Figure 3:
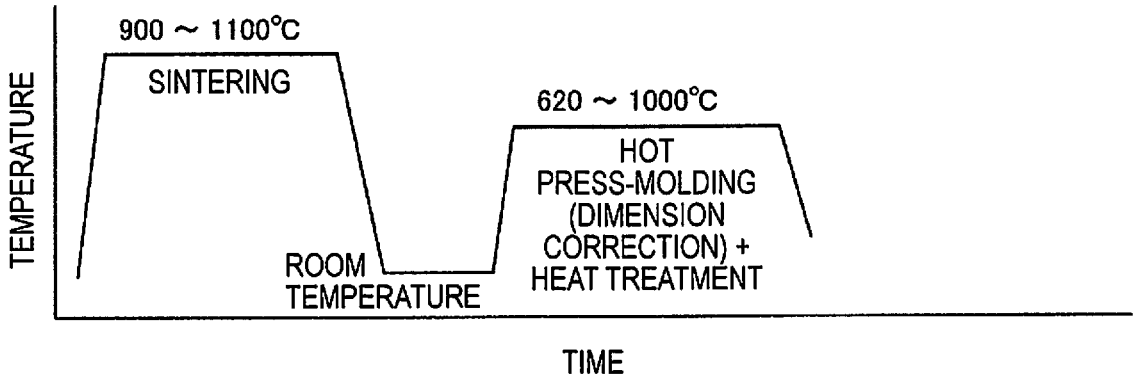
FIG. 3 is a graph showing temperature changes when carrying out a sintering step, a dimension correction step, and an aging heat treatment step, employing the sintered magnet manufacturing method.
Figure 4:
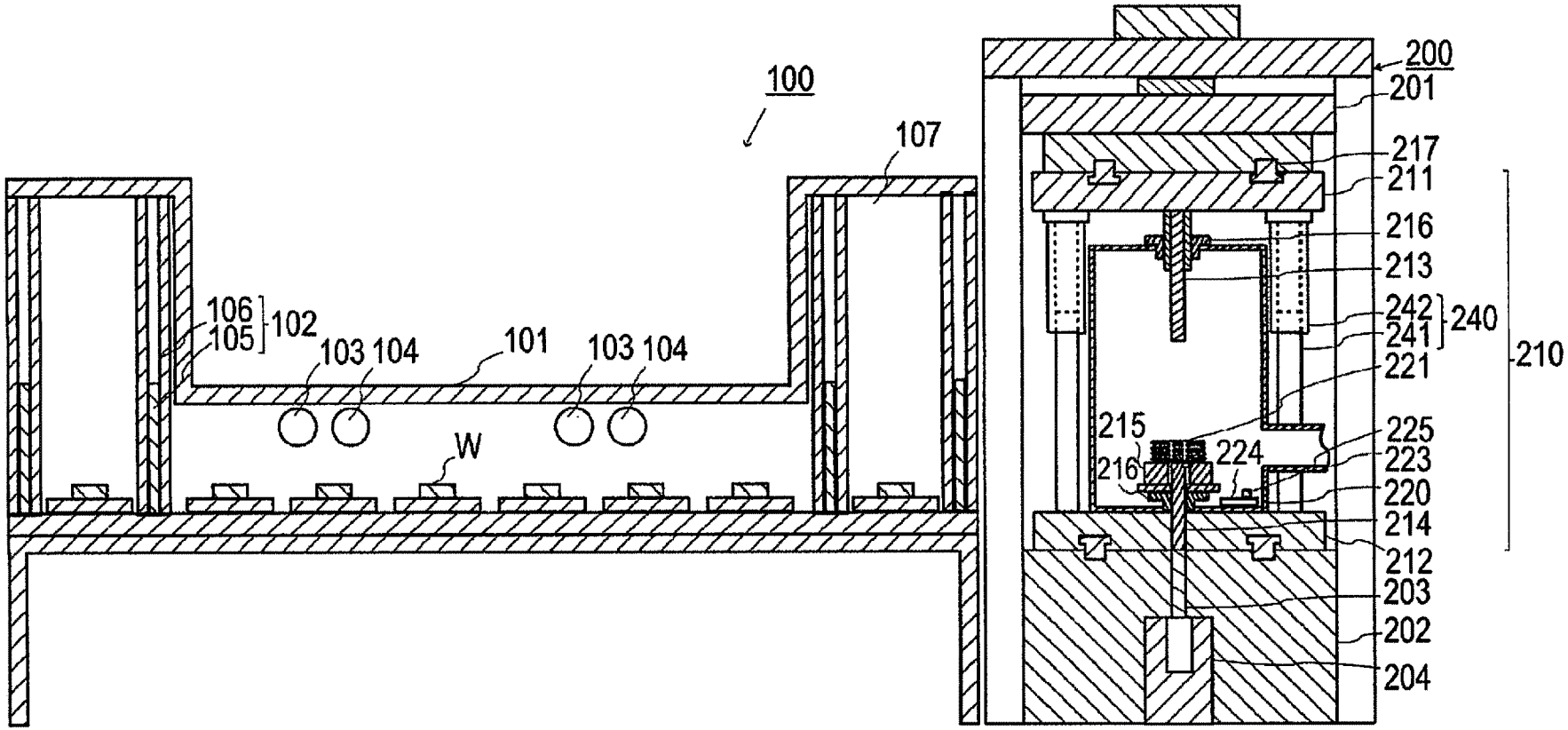
FIG. 4 is a cross-sectional view showing an apparatus used for the sintering step, the dimension correction step, and the aging heat treatment step in the sintered magnet manufacturing method.
Figure 5:
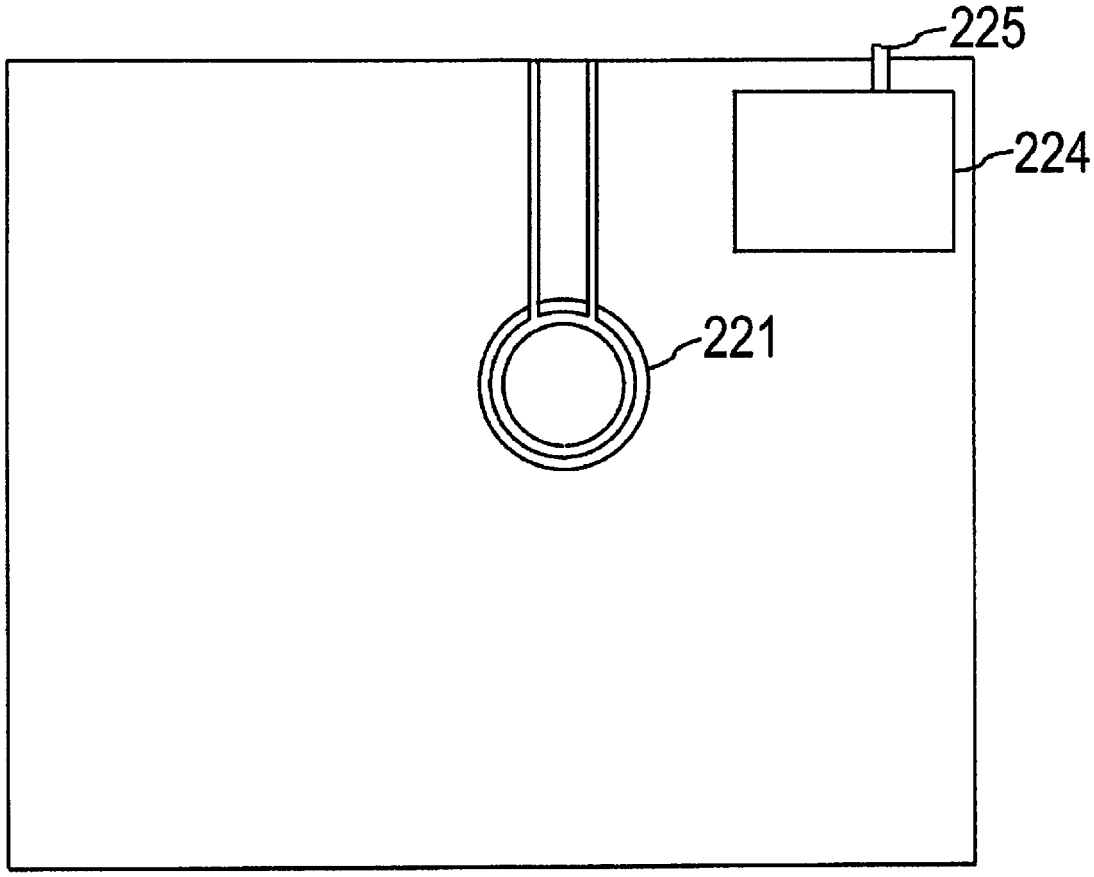
FIG. 5 is a plan view showing the interior of a containment vessel in the dimension correction section of the apparatus.

FIGS. 2 A-D are schematic views describing the sintered magnet manufacturing method according to the first embodiment of the present invention; and FIG. 3 is a graph showing temperature changes when carrying out a sintering step, a dimension correction step, and an aging heat treatment step, employing the sintered magnet manufacturing method. FIG. 4 is a cross sectional view showing an apparatus used for the sintering step, the dimension correction step, and the aging heat treatment step in the sintered magnet manufacturing method; and FIG. 5 is a plan view showing the interior of a containment vessel in the dimension correction section of the apparatus.

In the dimension correction step, in a generally non-oxidizing state, press-molding of a workpiece W is carried out with an upper mold 213 and a lower mold 214 which constitute a dimension correction section 200 shown in FIG. 2A, FIG. 2B, and FIG. 4, and dimension correction of the sintered magnet is carried out (step S6). The details are discussed below.

After dimension correction, aging heat treatment is carried out in a non-oxidizing state, and the coercive force of the sintered magnet is adjusted (step S7). In some cases, dimension correction of the sintered magnet is conducted at a higher temperature than aging heat treatment, and therefore dimension correction of the sintered magnet is conducted prior to aging heat treatment. The reason is that there is a risk that the temperature at which heat treatment is carried out will change the texture of the magnet, with the possibility of affecting the magnet characteristics.

After the aging heat treatment, a surface treatment involving Ni plating or the like is carried out in order to prevent rust and corrosion (step S8). Once the surface treatment has been completed, an inspection of magnetic characteristics, appearance, dimensions, and the like is carried out (step S9), and finally the material is magnetized through application of a pulsed magnetic field or static magnetic field, to manufacture a sintered magnet (step S10).

Next, the apparatus for embodying the sintering step, the dimension correction step, and the aging heat treatment step in the sintered magnet manufacturing method according to the present embodiment will be discussed in detail.

As shown in FIG. 4, the sintered magnet manufacturing apparatus according to the first embodiment has a sintering furnace 100 for carrying out the sintering process, and the dimension correction section 200 for carrying out the dimension correction step, the aging heat treatment step, and the cooling step. The sintering furnace 100 has a divider wall 101 for forming a space isolated from the outside, for sintering the green compact molded in a magnetic field, and a heater (not illustrated) for heating the inside of the sintering furnace. The sintering furnace 100 has a shutter mechanism 102 for introducing and removing the green compact from inside the sintering furnace at an entry port and an exit port, and for closing off the entry/exit port after the green compact has been conveyed therein, in order to bring about a non-oxidizing state.

The sintering furnace 100 further has an introduction duct 103 for introducing into the sintering furnace 100 a heated atmosphere generated by the heater, an exhaust duct 104 for discharging gases produced during sintering from the sintering furnace interior, and a cooling chamber 107 for cooling the magnet after sintering.

The divider wall 101 is formed by a material having ample heat resistance, such as ceramic, making it possible to heat the sintering furnace interior up to about 1,100° C. As examples of the heater there may be cited a metal heater, which is advantageous from the point of carrying out uniform heating, or a molybdenum heater, which is advantageous from standpoint of being able to withstand high temperatures of 1,000° C. or above; however, there is no limitation to these.

The introduction duct 103 introduces into the sintering furnace interior the heated atmosphere generated by the heater, thereby adjusting the sintering furnace interior to predetermined temperature. The size, shape, placement, and so on of the introduction duct 103 will be determined by the temperature adjustment range of the sintering furnace interior. The exhaust duct 104 is connected to a negative pressure-generating means such as a compressor, and is installed for the purpose of discharging from the sintering furnace interior gases and the like produced from the sintered magnet during sintering, and for bringing the chamber interior to a non-oxidizing state. Due to the installation of the exhaust duct, gases produced during sintering are discharged, maintaining the chamber interior in a non-oxidizing state, and preventing a decline in magnet characteristics.

The shutter mechanism 102 has a shutter 105 that moves in a vertical direction at the entry/exit port of the sintering furnace 100, and a guide rail 106 for guiding the shutter 105 during vertical motion, by a drive mechanism, not illustrated. The shutter 105 opens and shuts the entry/exit port of the sintering furnace 100 by moving along the guide rail 106.

The cooling chamber 107 has, e.g., a water-cooled jacket, to cool the heated sintered magnet down to about room temperature.

The dimension correction section 200, which carries out dimension correction of the sintered magnet, has an upper slide 201 and a bolster 202 capable of moving relatively closer and apart, and a die set 201 capable of being attached to and detached from the dimension correction section 200. The die set 201 has an upper die 211, a lower die 212 positioned in opposition to the upper die 211, and an adjustment mechanism 240 for aligning the positions of the upper die 211 and the lower die 212. The die set 210 also has a containment vessel 220 placed on the lower die 211, and furnished with a correction mold for correcting the dimensions of the workpiece W (the sintered magnet targeted for dimension correction).

The containment vessel 220 has a heater 221 for heating the sintered magnet, a pipeline duct 223 for forming a non-oxidizing state in the interior of the containment vessel 220, a cooling plate 224 for cooling the sintered magnet subsequent to dimension correction, and a cooling pipe 225 for circulating cooling water or the like to the cooling plate 224.

In FIG. 4, the upper slide 201 is moved closer to or away from the bolster 202 through hydraulic pressure. The upper slide 201 has a linking pin 217 for detachably securing the upper die 211 of the die set 210, and the bolster 202 has a linking pin 217 for detachably securing the lower die 212 of the die set 210. The bolster 202 is furnished with a liftable knockout bar 203 for extracting the sintered magnet from the correction mold, after the dimensions have been corrected.

The correction mold is formed by an upper mold 213, a lower mold 214 and an outside peripheral mold 215. The knockout bar 203 and the lower mold 214 form a knockout mechanism for extracting the workpiece W. Symbol 204 in FIG. 4 indicates a hydraulic cylinder for driving lifting and lowering of the knockout bar 203.

The die set 210 is secured in the dimension correction section 200 by securing the upper die 211 to the upper slide 201 with the linking pin 217, and securing the lower die 212 to the bolster 202 with the linking pin 217. The upper die 211 has interlocking operation with the upper slide 201.

The adjustment mechanism 240 has a guiding rod 241 furnished to the lower die 212, and a guiding cylinder 242 furnished to the upper die 211, for slidably retaining the guiding rod 241. Position alignment of the upper die 211 and the lower die 212 is carried out through sliding motion of the guiding rod 241 within the guiding cylinder 242. In the present embodiment, even when the upper die 211 has been positioned furthest away from the lower die 212, the guiding rod 241 does not detach from the guiding cylinder 242, and accuracy of position is ensured thereby.

The upper die 211 and the lower die 212 are secured to the upper slide 201 and the bolster 202 by the linking pins 217. For this reason, the die set 210 can be readily attached to and detached from the dimension correction section 200, simply by detaching the linking pins 217.

The containment vessel 220 is placed on the lower die 212, so that machining of the sintered magnet targeted for machining may take place in a non-oxidizing state. The pipeline duct 223 is connected to a vacuum pump (not illustrated) for forming a non-oxidizing state within the chamber. A valve (not illustrated) is furnished midway along the pipeline path, and by switching the path with the valve after placing the containment vessel interior in a vacuum, the containment vessel interior can be filled with an inert gas such as nitrogen gas or the like. When metals such as Dy, Tb, Pr, or the like have been added to Nd at a level of 10 ppm or less in an Nd—Fe—B sintered magnet, the oxygen concentration within the chamber is preferably brought to 1 ppm or less. The reason is that Dy, Tb, and Pr are more prone to oxidation than Nd.

With the containment vessel interior maintained in a vacuum state, the correction mold to which the upper die 211 and the lower die 212 have been attached is inserted into the containment vessel interior from the vertical direction in FIG. 4. The lower mold 214 is installed secured by a securing fixture 216 from the lower die 212, and the upper mold 213, like the lower mold 214, is installed secured to the upper die 211 by a securing fixture 216. Above the lower die 214 in FIG. 4, the outside peripheral mold 215, which encloses the sintered magnet targeted for machining, is attached to the lower mold through engagement with the flanged shape of the distal end of the lower mold 214.

The containment vessel 220 is furnished with a magnet introduction/removal mechanism for placing on the lower mold the sintered magnet conveyed by the sintering furnace 100, and for replacing the sintered magnet with the next one, after dimension correction.

The magnet introduction/removal mechanism in the present embodiment is formed by a robot arm, not illustrated, for carrying out rapid introduction and removal of sintered magnets extracted from the sintering furnace 100.

The heater 221 is furnished in proximity to the upper mold 213, the lower mold 214, and the outside peripheral mold 215, and is formed to hollow shape to allow sliding motion of the upper mold 213. While there are no particular limitations as the constitution of the heater 221, an electrical heater, a high-frequency induction heater, or the like can be cited.

As shown in FIG. 5, the cooling plate 224 and the cooling pipe 225 are situated away from the heater 221, which is the heat source, in the containment vessel interior. A water jacket is formed in the interior of the cooling plate 224. A cooling medium such as water introduced through the cooling pipe 225 is sprayed onto the cooling plate 224, thereby force-cooling the sintered magnet which has been placed on the cooling plate 224. Conventionally, the workpiece was allowed to cool naturally after heating, but by using the cooling plate 224 and the cooling pipe 225, the cooling time can be shortened, and the machining time shortened.

Next, the sintering step, the dimension correction step, and the aging heat treatment step in the sintered magnet manufacturing method according to the first embodiment will be described. First, the shutter 105 of the sintering furnace 100 is raised, and the workpiece W, i.e., the green compact, is conveyed inside. Then, in synchronization with movement of the conveyance path on which the workpiece W has been placed, sintering of the workpiece W is brought about in a non-oxidizing state while heating it to 900° C.-1,100° C. with the heater as shown in FIG. 3, forming a sintered magnet. The workpiece W having passed through the sintering furnace 100 interior is extracted by raising the shutter 105 on the exit port side, and cooled to room temperature in the cooling chamber 107.

Once cooled to room temperature, the workpiece W is conveyed into the containment vessel interior in the dimension correction section 200, and placed on the mold 214 by the robot arm. The outside peripheral mold 215 then installed, maintaining the position of the workpiece W in the horizontal direction. In consideration of possible deformation of the sintered magnet, the outside peripheral mold 215 does not apply pressure to the sintered magnet; however, in cases of carrying out dimension correction of a side surface, a constitution by which pressure is applied would be acceptable.

Next, employing the heater 221, atmospheric heating or high-frequency heating is carried out to bring the molds 213, 214, 215 and the workpiece W to about 620° C.-1,000° C. Within the 620° C.-1,000° C. range, it is preferable to conduct the operation at 800° C. or below, with a view to preventing thermal deformation of the sintered magnet itself, and accelerated oxidation. Once the workpiece W temperature has reached a set temperature, the upper slide 201 is lowered while maintaining the temperature, whereupon the upper mold 213 is lowered in association with lowering of the upper slide 201, and the workpiece W is press-molded in the space inside the correction mold, as shown in FIG. 2A and FIG. 2B.

In preferred practice, the aforedescribed press-molding is carried out for about 0.1-30 minutes with the upper mold 213 maintained at bottom dead center, so that correction can be carried out with good dimensional accuracy. In cases in which the containment vessel interior has been filled with inert gas, holding the system at the set temperature may be carried out by circulating the gas through the containment vessel interior. The pressure applied during press machining should be such that pressure is applied at a pressure level below yield stress, while taking into consideration the fact that the yield stress of the magnet declines due to heating of the sintered magnet.

By carrying out press-molding in the aforedescribed heated atmosphere, strain produced in the sintered magnet during sintering is corrected, and the shape of the magnet can be corrected to within a predetermined dimensional tolerance range.

After dimension correction, with the upper mold 213 still maintained at bottom dead center, an aging heat treatment of predetermined duration is carried out, using the heater 211 to adjust the temperature of the workpiece W to about 500° C.-950° C. lower than during dimension correction. The aforedescribed step improves the relative density of the texture of the sintered magnet, improving the residual magnetic flux density, mechanical strength, and the like.

Once the aging heat treatment is completed, the workpiece W is released from the mold as shown in FIG. 2C, and the magnet surface is cooled by the cooling plate 224 and the cooling pipe 225, to a temperature at which oxidation proceeds with difficulty. The aforedescribed sintering step, dimension correction step, aging heat treatment step, and cooling step are all carried out in a non-oxidizing state. Thereafter, as shown in FIG. 2C, the sintered magnet is conveyed out to the outside from the containment vessel 220, and after surface treatment, inspection, and magnetization, is shipped out.

In the conventional manufacturing steps for sintered magnets, steps in which the green compact is heated, cooled, and then reheated, are conducted from the sintering step to the aging heat treatment step, for the purpose of adjusting magnet characteristics such as the coercive force. After cooling the magnet to room temperature subsequent to aging heat treatment, grinding machining is carried out by way of dimension correction. Methods in which reheating is conducted subsequent to heating and cooling during the sintering step to the aging heat treatment step have poor energy efficiency, and therefore lead to increased cost of products. Additionally, rare earths used in sintered magnets have high scarcity values, and when a grinding step is carried out, some rare earth that is not used in the product is produced, and the yield ratio of material is poor.

In contrast to this, with the sintered magnet manufacturing method according to the present embodiment, by press-molding the sintered magnet in a heated atmosphere to carry out dimension correction subsequent to the sintering step, the phenomenon whereby a portion of the material is ground away and can no longer be used, such as is the case with grinding machining, is eliminated. Therefore, the yield ratio of material can be improved.

Additionally, because the heated atmosphere generated during dimension correction is utilized in the aging heat treatment, the energy needing to be generated by the heater and the like for the purpose of aging heat treatment can be reduced, and better energy efficiency achieved. Additionally, because dimension correction is carried out under a heated atmosphere, and the heat generated during dimension correction is utilized thereafter when carrying out the aging heat treatment step, the change in temperature to reach that needed for aging heat treatment is smaller, and the change in temperature of structures forming the apparatus can be minimized commensurately.

Further, whereas grinding machining employed in conventional dimension correction was carried out after having cooled the magnet to room temperature subsequent to heat treatment, in the present embodiment, dimension correction is carried out under a heated atmosphere, whereby the time to cool the magnet can be reduced, and the time required for the step can be shortened.

With the sintered magnet manufacturing method according to the first embodiment, as described above, the dimensions of the sintered magnet are corrected through press-molding in a heated atmosphere after the sintering step, and thereafter aging heat treatment is carried out in the containment vessel 220 interior. Therefore, removal of a portion of the material, as occurs with mechanical machining processes, is eliminated, and the yield ratio of material can be further improved.

Additionally, because the aging heat treatment is carried out utilizing the heated atmosphere generated during dimension correction, the amount of heat needing to be generated during heat treatment can be reduced, and more efficient utilization of energy achieved. Additionally, because the aging heat treatment is carried out utilizing the heated atmosphere generated during dimension correction, the change in temperature to reach that needed for aging heat treatment is smaller, and the change in temperature of structures within the apparatus can be minimized. Further, because the dimension correction step is carried out under a heated atmosphere, there is no need to cool the magnet to room temperature as in conventional practice, and the required time for the steps can be shortened.

Additionally, because the sintering step, dimension correction step, and aging heat treatment step are carried out in a non-oxidizing state, oxidation of the sintered magnet can be prevented, and decline in the magnet characteristics prevented.

Additionally, due to a constitution whereby the sintered magnet is heated to 800° C. or below and press-molding is carried out during dimension correction, not only can the yield of material be improved, but thermal deformation of the sintered magnet itself, and accelerated oxidation, can be prevented as well.

Second Embodiment

Figure 7:
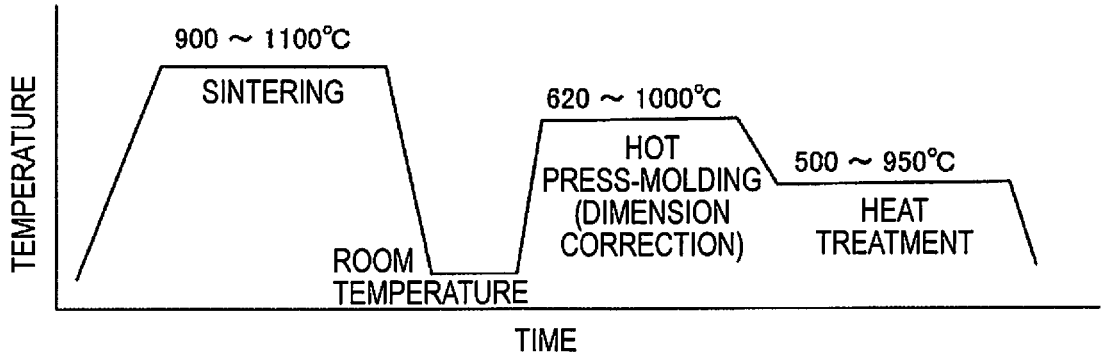
FIG. 7 is a graph showing temperature changes when carrying out a sintering step, a dimension correction step, and an aging heat treatment step in the sintered magnet manufacturing method.
Figure 8:
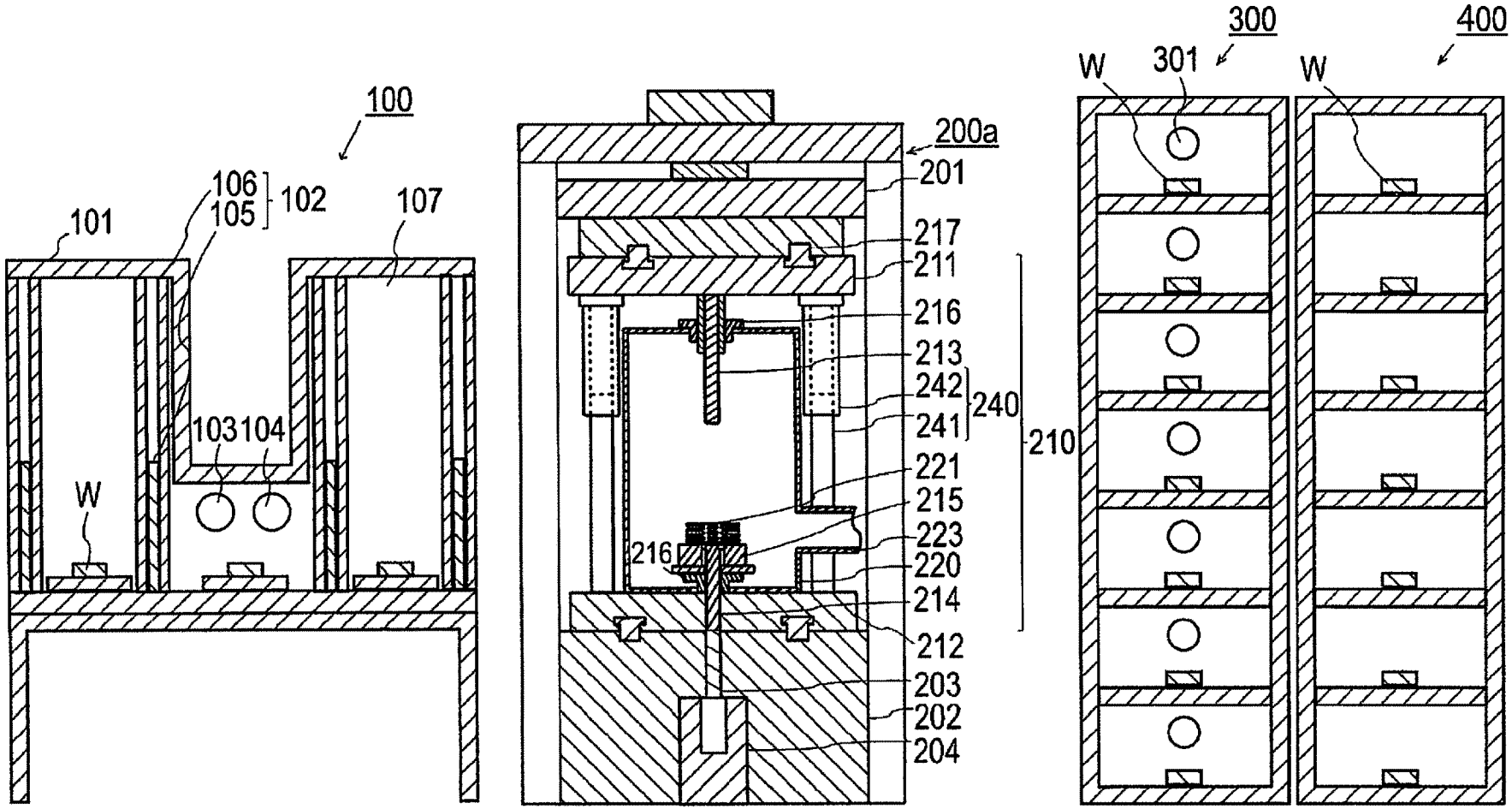
FIG. 8 is a cross-sectional view showing an apparatus used for the sintering step, the dimension correction step, and the aging heat treatment step in the sintered magnet manufacturing method.

FIGS. 6A-F are schematic views describing the sintered magnet manufacturing method according to a second embodiment of the present invention, and FIG. 7 is a graph showing temperature changes in a case of carrying out a sintering step, a dimension correction step, and an aging heat treatment step in the sintered magnet manufacturing method. FIG. 8 is a cross sectional view showing an apparatus used for the sintering step, the dimension correction step, and the aging heat treatment step in the sintered magnet manufacturing method. Features equivalent to those in the first embodiment have been assigned like symbols, and descriptions thereof are omitted.

In the first embodiment, aging heat treatment is carried out in the containment vessel interior of the dimension correction section 200, and the sintered magnet is cooled; however, the aging heat treatment step and the cooling step may be conducted in the following manner.

In the second embodiment, a heat treatment chamber 300 and a cooling chamber 400 are furnished, in addition to the sintering furnace 100 and a dimension correction section 200*a*. For convenience in illustration, the sintering furnace 100 is depicted with reduced distance on the conveyance path.

The heat treatment chamber 300 is furnished separately from a dimension correction section 200*a*, and is designed to contain the sintered magnet having passed through the sintering step and the dimension correction step, and to carry out an aging heat treatment for a predetermined temperature and time. In the second embodiment, the heat treatment chamber 300 connects to the pipeline duct 223 of the dimension correction section 200*a*, and a heated atmosphere generated in the dimension correction section interior is suctioned in through the duct 223, and directed into the heat treatment chamber 300 through a duct 301.

Additionally, a heater, not illustrated, is installed in the heat treatment chamber 300, and is utilized, together with heated gases fed from the dimension correction section 200*a*, to increase or maintain the internal temperature of the heat treatment chamber 300 at a predetermined value. In cases in which the treatment time and treatment temperature differ depending on the magnet, by forming the dimension correction section and the heat treatment chamber separately as in the second embodiment, the treatment time and treatment temperature can be readily adjusted.

The cooling chamber 400 is formed similarly to the cooling chamber 107 of the first embodiment, and description thereof is therefore omitted.

Next, the sintering step, the dimension correction step, and the aging heat treatment step in the sintered magnet manufacturing method according to the second embodiment will be described. As in the first embodiment, upon completion of molding in a magnetic field, the green compact undergoes a sintering step carried out at 900° C.-1,100° C. in the sintering furnace 100 as shown in FIG. 7, to form a sintered magnet.

The workpiece W is then placed on the lower mold 214, positioned by the outside peripheral mold 215, and dimension correction of the outer shape is carried out through press-molding at 620° C.-1,000° C., as shown in FIG. 6A and FIG. 6B. Subsequent to dimension correction, the sintered magnet is released from the mold as shown in FIG. 6C to FIG. 6F, and after undergoing an aging heat treatment step at 500° C.-950° C. carried out in the temperature-controlled heat treatment chamber 300, is cooled to room temperature in the cooling chamber 400, and then conveyed out to the outside of the equipment.

In the sintered magnet manufacturing method according to the first embodiment, the dimension correction step and the aging heat treatment step are carried out in the dimension correction section interior. The dimension correction step is carried out at 620° C.-1,000° C., and the aging heat treatment step at 500° C.-950° C.; with the sintered magnet manufacturing method according to the second embodiment, however, the aging heat treatment step and the cooling step are carried out in separate spaces. For this reason, the need to adjust the chamber interior in the dimension correction section 200*a* to one suitable for heat treatment subsequent to dimension correction is obviated, and the product cycle time can be shortened commensurately.

Even in cases in which, due to limitations imposed by the layout within the factory, a cooling plate and a cooling pipe cannot be installed in the dimension correction section, by separately installing the heat treatment chamber 300 and the cooling chamber 400 as in the second embodiment, the layout within the factory can be accommodated in a flexible manner. Further, by separately furnishing the dimension correction section 200*a* on the one hand, and the heat treatment chamber 300 and the cooling chamber 400 on the other, the constitution of each can be maintained on an individual basis, whereby the ease of maintenance can be improved.

With the sintered magnet manufacturing method according to the second embodiment as described above, the aging heat treatment step and the cooling step are carried out in different apparatus from dimension correction step, and therefore the labor entailed for temperature adjustment in the dimension correction section 200*a* can be eliminated, and the product cycle time shortened commensurately. Moreover, by furnishing the heat treatment chamber 300 and the cooling chamber 400 separately from the dimension correction section 200*a*, the layout within the factory can be accommodated in a flexible manner. Further, by separately furnishing the dimension correction section 200*a* on the one hand, and the heat treatment chamber 300 and the cooling chamber 400 on the other, the constitution of each can be maintained on an individual basis, whereby the ease of maintenance can be improved.

Third Embodiment

Figure 9:
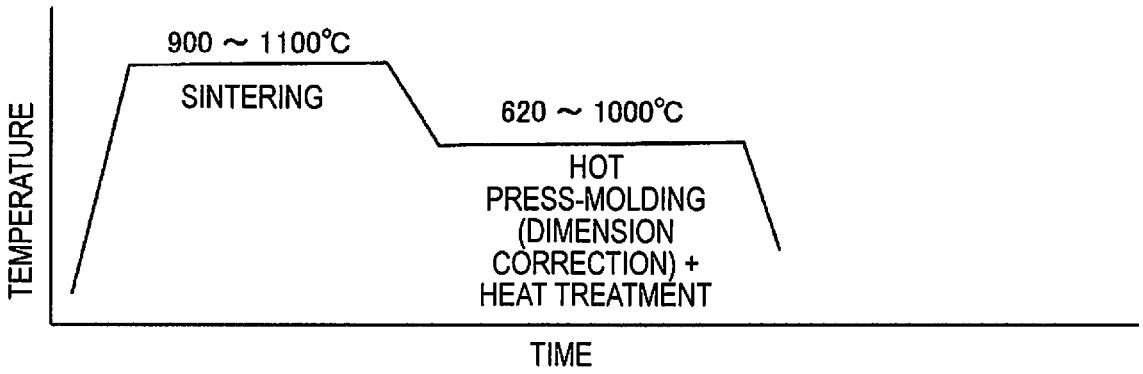
FIG. 9 is a graph showing temperature changes in a case of carrying out a sintering step, a dimension correction step, and an aging heat treatment step in the sintered magnet manufacturing method according to a third embodiment of the present invention.
Figure 10:
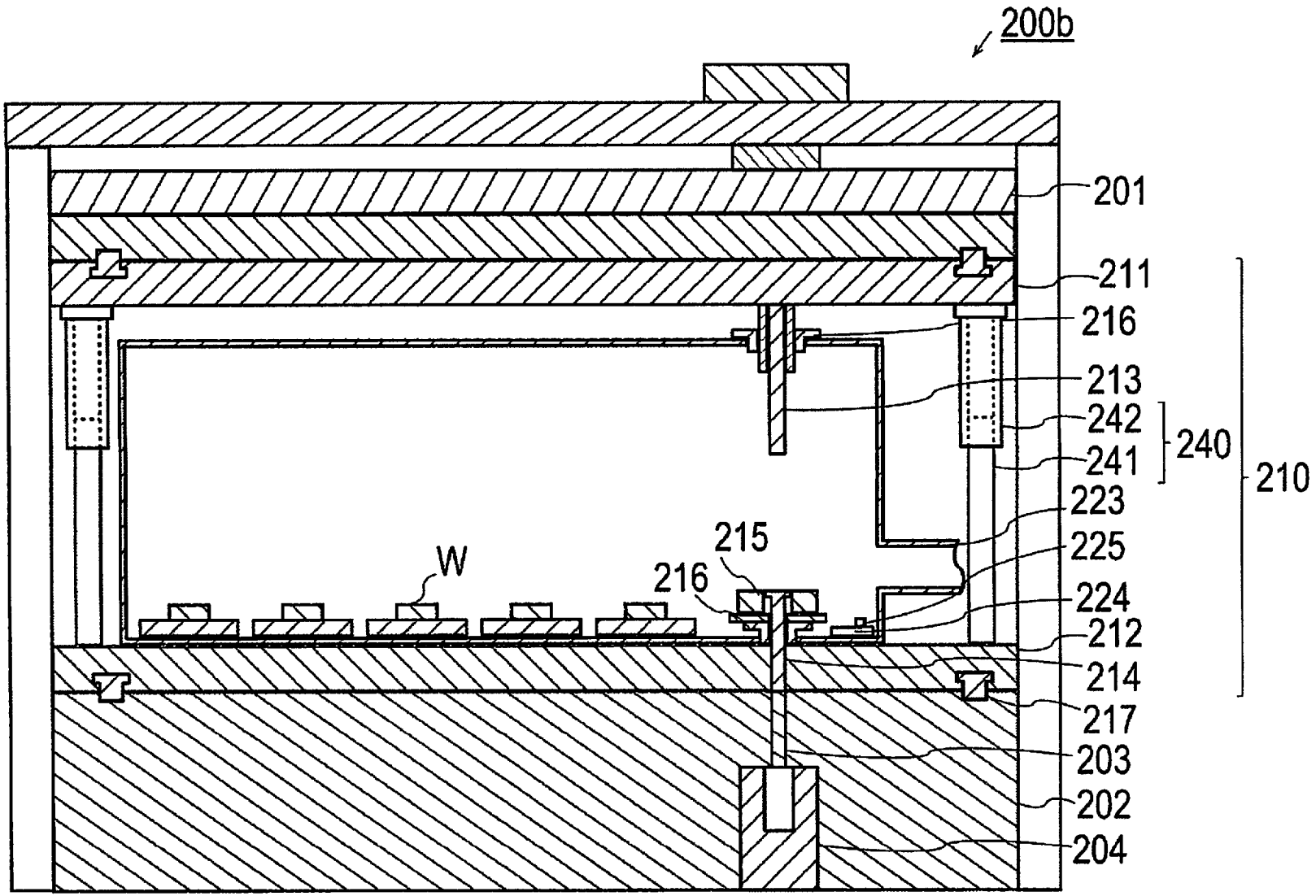
FIG. 10 is a cross-sectional view showing an apparatus used for the sintering step, the dimension correction step, and the aging heat treatment step in the sintered magnet manufacturing method.

FIG. 9 is a graph showing temperature changes when carrying out a sintering step, a dimension correction step, and an aging heat treatment step in the sintered magnet manufacturing method according to a third embodiment of the present invention, and FIG. 10 is a cross sectional view showing an apparatus used for the sintering step, the dimension correction step, and the aging heat treatment step in the sintered magnet manufacturing method. In the first and second embodiments, the sintering step and the dimension correction step are carried out by separate constitutions; however, it would be possible to adopt a constitution such as the following. The schematic procedure for manufacturing sintered magnets in the third embodiment is comparable to that in FIG. 2A to FIG. 2B, and illustration has therefore been omitted.

In the third embodiment, the containment vessel interior of the dimension correction section is furnished with a conveyance space for the workpiece W, and the sintering step can be conducted in the containment vessel interior.

Functions assigned to the sintering furnace have been consolidated into the containment vessel 220, which is formed such that temperature management of the chamber interior can be accomplished by a heater (not illustrated) in the containment vessel interior. A convey-in port 221 for conveying in the workpiece W is installed in the containment vessel 220.

Next, the sintering step, the dimension correction step, and the aging heat treatment step in the sintered magnet manufacturing method according to the third embodiment will be described. Firstly, the workpiece W, i.e., a green compact, is conveyed in through the convey-in port 221, and a sintering step is carried out at 900° C.-1,100° C. by a heater, until the compact has been conveyed as far as the constitution serving as the dimension correction section, as shown in FIG. 9.

Next, the sintered magnet, while placed on the lower mold 214 by the robot arm and positioned by the outside peripheral mold 215, is press-molded in a heated atmosphere at 620° C.-1,000° C., by lowering the upper mold 213, and dimension correction of the outer shape is carried out.

After dimension correction, an aging heat treatment is carried out for a predetermined time on the sintered magnet in the containment vessel interior, with the temperature adjusted to 500° C.-900° C. After the aging heat treatment, the sintered magnet is released from the mold, transported to the cooling plate 224, and cooled to room temperature by a gas from the cooling pipe 225, then conveyed outside the apparatus. With the sintered magnet manufacturing apparatus according to the third embodiment, not only can the heated atmosphere produced during hot pressing be utilized during the aging heat treatment step, but the heated atmosphere produced during the sintering step can be utilized in the dimension correction step as well, whereby energy can be utilized even more efficiently.

Additionally, by utilizing the heated atmosphere produced during the sintering step, the heating time needed to raise the temperature to that necessary for dimension correction can be shortened. Further, because dimension correction and aging heat treatment are carried out while utilizing heat produced during the sintering step, and because the sintering step, the dimension correction step, and the aging heat treatment step are conducted at progressively higher temperatures, deformation due to temperature changes of structures within the apparatus can be minimized, as in the preceding embodiments. Further, because the sintering step, the dimension correction step, the aging heat treatment step, and the cooling step are carried out within a single apparatus, the constitution of the apparatus can be simpler.

With the sintered magnet manufacturing apparatus according to the third embodiment as described above, a conveyance space is installed in the containment vessel interior formed to a non-oxidizing state, and the sintering step, the dimension correction step, the aging heat treatment step, and the cooling step are carried out within the apparatus. Therefore, the heated atmosphere produced in the sintering step can be utilized in the dimension correction step, and greater energy efficiency can be achieved.

Additionally, because the heated atmosphere of the sintering step can be utilized, the heating time to reach the temperature needed for dimension correction can be shortened. Additionally, the sintering step, the dimension correction step, and the aging heat treatment step are conducted at progressively higher temperatures, and deformation due to temperature changes of structures within the apparatus can be minimized. Further, because the sintering step, the dimension correction step, the aging heat treatment step, and the cooling step are carried out within a single apparatus, the constitution of the apparatus can be simpler.

Fourth Embodiment

Figure 11:
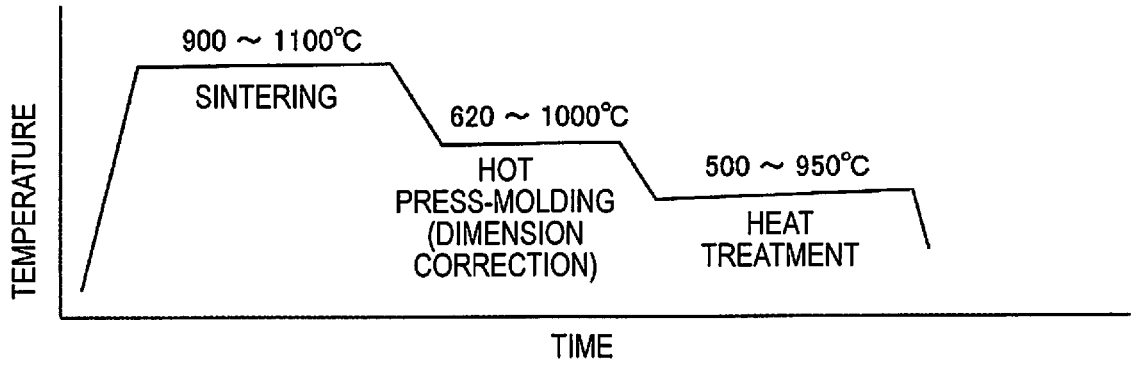
FIG. 11 is a graph showing temperature changes when carrying out a sintering step, a dimension correction step, and an aging heat treatment step in the sintered magnet manufacturing method according to a fourth embodiment of the present invention.
Figure 12:
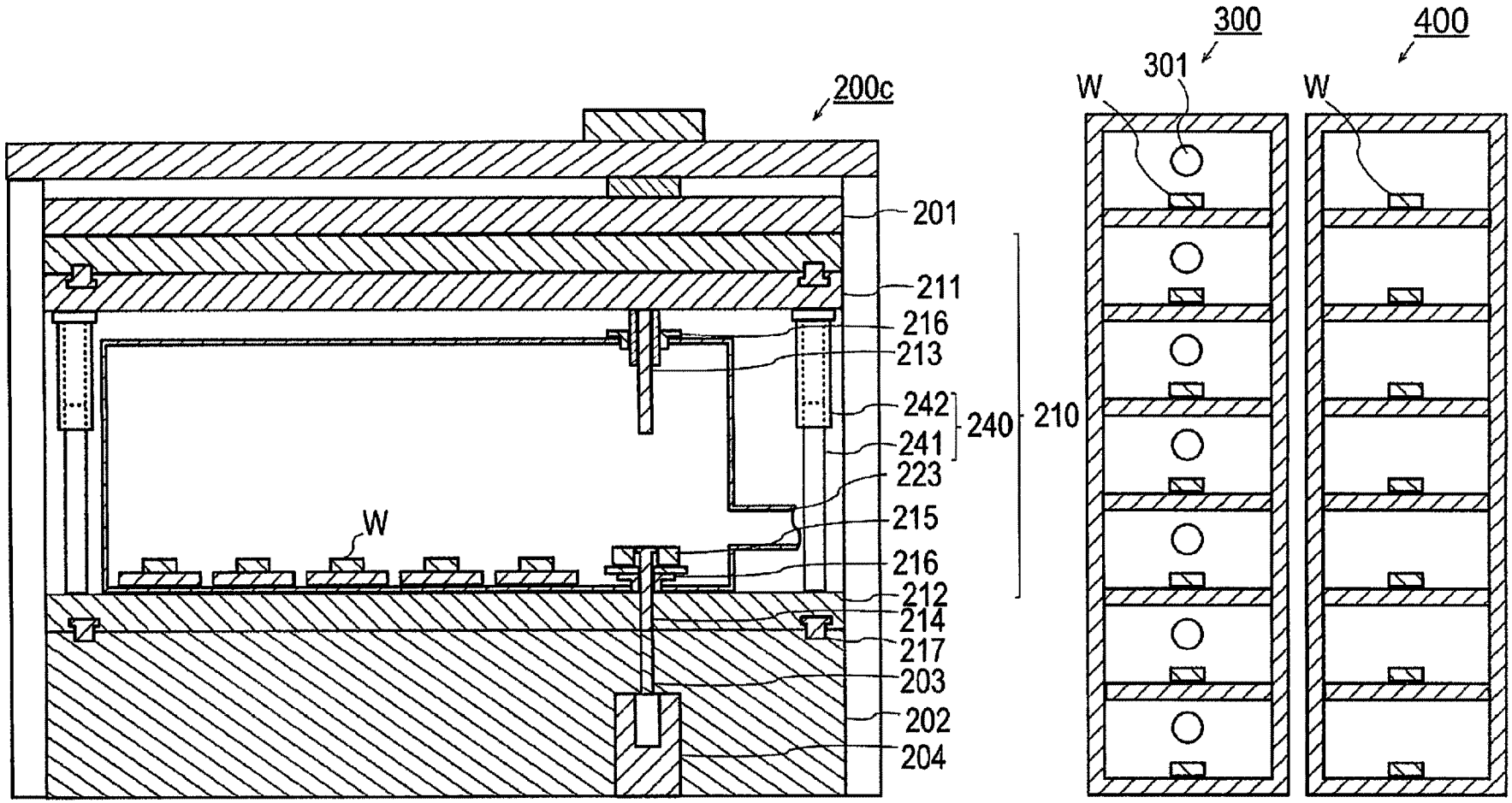
FIG. 12 is a cross-sectional view showing an apparatus used for the sintering step, the dimension correction step, and the aging heat treatment step in the sintered magnet manufacturing method.
Figures 13A, 13B, 13C, 13D, 13E:
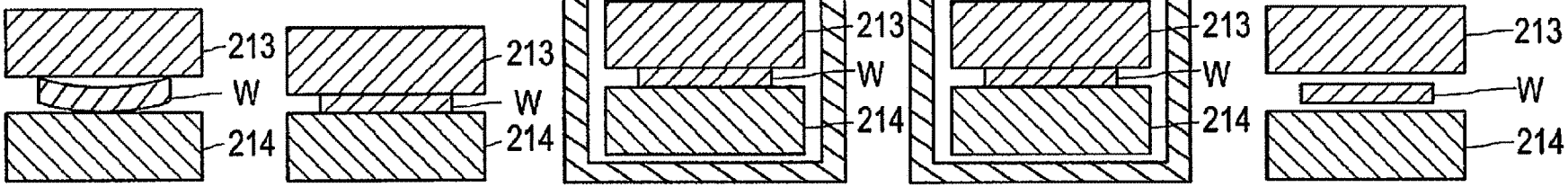
FIGS. 13A-E are schematic views showing a modification example of the second or fourth embodiment of the present invention.

FIG. 11 is a graph showing temperature changes when carrying out a sintering step, a dimension correction step, and an aging heat treatment step in the sintered magnet manufacturing method according to a fourth embodiment of the present invention, and FIG. 12 is a cross sectional view showing an apparatus used for the sintering step, the dimension correction step, and the aging heat treatment step in the sintered magnet manufacturing method. In the third embodiment, the sintering step, the dimension correction step, the aging heat treatment step, and the cooling step are carried out within the same apparatus; however, the following constitution is possible as well. The schematic procedure for manufacturing sintered magnets in the fourth embodiment is comparable to that in FIG. 6A to FIG. 6F, and illustration has therefore been omitted.

In the fourth embodiment, as in the third embodiment, the containment vessel 220 interior is furnished with a conveyance space for conducting the sintering step, and temperature adjustments can be carried out during the sintering step and the dimension correction step in the containment vessel 220 by a heater, not illustrated. Additionally, in the fourth embodiment, as in the second embodiment, a heat treatment chamber 300 for carrying out aging heat treatment, and a cooling chamber 400 for carrying out a cooling step, are installed separately in addition to a dimension correction section 200*c*.

Next, the process from the sintering step to the aging heat treatment step in manufacture of sintered magnets according to the fourth embodiment will be described. Firstly, in the same manner as in the third embodiment, the workpiece W, i.e., a green compact, is conveyed in through the convey-in port 221 of the containment vessel 220, and, in synchronization with movement of the conveyance path on which the workpiece W has been placed, the workpiece W is sintered at 900° C.-1,100° C. as shown in FIG. 11, forming a sintered magnet. The workpiece W is then placed on the lower mold 214, positioned by the outside peripheral mold 215, and the outer shape is dimension-corrected through press-molding at 620° C.-1,000° C.

While maintaining the non-oxidizing state, the dimension-corrected sintered magnet is released from the mold, extracted from the apparatus, and undergoes aging heat treatment carried out at 500° C.-950° C. in the heat treatment chamber 300, to adjust the magnet texture. The magnet is then transported to the cooling chamber 400, and after being cooled to room temperature, is conveyed out to the outside, which has not been adjusted to a non-oxidizing state.

With the manufacturing apparatus according to the fourth embodiment, the heated atmosphere produced in the sintering step can be utilized during dimension correction, and the heated atmosphere in the containment vessel interior subsequent to dimension correction can be utilized for aging heat treatment, whereby greater energy efficiency can be achieved. Additionally, by furnishing the heat treatment chamber 300 and the cooling chamber 400 separately from the apparatus for carrying out the sintering step and the dimension correction step, the need to adjust the containment vessel interior subsequent to dimension correction to the temperature necessary for heat treatment is obviated, and the product cycle time can be shortened commensurately.

Additionally, by installing the heat treatment chamber 300 and the cooling chamber 400 separately from the dimension correction section 200*c*, a factory layout in which a large-scale apparatus cannot be installed can be accommodated in a flexible manner. Additionally, separating the constitution for carrying out the sintering step and the dimension correction step from the heat treatment chamber 300 and the cooling chamber 400 permits shutdown of only the necessary portion of the entire manufacturing apparatus during maintenance, and ease of maintenance can be improved.

Additionally, due to the ability to utilize the heated atmosphere during the sintering step, the heating time to bring the temperature to that necessary for dimension correction can be shortened. Further, because the sintering step, the dimension correction step, and the aging heat treatment step are conducted at progressively higher temperatures, deformation due to temperature changes of the structures forming the apparatus can be minimized.

Fifth Embodiment

Figure 14:
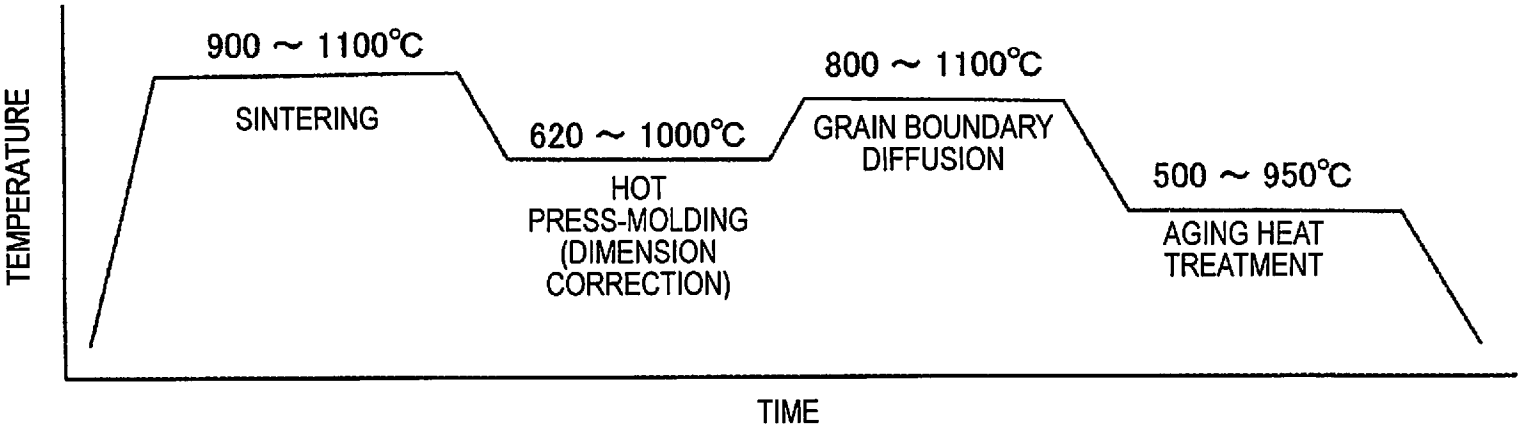
FIG. 14 is a graph showing temperature changes in a case of carrying out the sintered magnet manufacturing method according to a fifth embodiment of the present invention.

FIG. 14 is a graph showing temperature changes when carrying out the sintered magnet manufacturing method according to a fifth embodiment of the present invention. In the first to fourth embodiments, a magnet powder containing a rare earth element was compacted to form a green compact, on which were carried out sintering and dimension correction, and aging heat treatment; however, the following steps may be conducted besides the aforedescribed ones. The sintered magnet manufacturing apparatus is the same as in the first embodiment, and therefore description thereof is omitted.

In the fifth embodiment, in addition to the sintering step, the dimension correction step, and the aging heat treatment step, a grain boundary diffusion step to improve the magnet characteristics is carried out by equipment such as the dimension correction section 200*b* shown in FIG. 10. As shown in FIG. 14, in the fifth embodiment, after carrying out the sintering step at 900° C.-1,100° C., and carrying out dimension correction of the sintered magnet at 620° C.-1,000° C., the grain boundary diffusion step may be carried out at 800° C.-1,000° C., and thereafter the aging heat treatment step carried out at 500° C.-950° C. In the first embodiment, it was indicated that the time and energy needed to form a heated atmosphere when carrying out aging heat treatment could be reduced by utilizing the heated atmosphere formed during the dimension correction step, when carrying out aging heat treatment. This can be applied analogously to the grain boundary diffusion process for preventing a decline in the retention characteristics of the sintered magnet.

Heat is sometimes employed when bringing about diffusion of heavy rare earth elements such as Dy, Tb, and the like, and by carrying out the grain boundary diffusion step, the decline of magnet characteristics such as retention force and the like of the dimension-corrected sintered magnet can be prevented. Additionally, by carrying out the dimension correction step as in the third embodiment, dimension correction of the sintered magnet can be accomplished at a good yield ratio of material; and by carrying out subsequent steps in the same space as that in which preceding steps were carried out, thermal energy losses and production lead times may be reduced, and deformation of structures forming the manufacturing apparatus canis less likely to occur, due to the smaller changes in temperature. In the present embodiment, provided that two or more successive steps, from among steps preferably carried out in the same equipment, can be carried out in the same equipment, the equipment may take the form of separate units, as with the sintering furnace 100 and the dimension correction section 200 of the first embodiment shown in FIG. 4.

As in the third embodiment, the sintering step, the dimension correction step, the grain boundary diffusion step, and the aging heat treatment step are carried out in a space in a non-oxidizing state. When the grain boundary diffusion step is carried out, the surface of the magnet, which is rare earth-rich, is in a state of being prone to oxidation, but by carrying out the grain boundary diffusion step in a non-oxidizing state, oxidation of the magnet and decline in the magnetic characteristics due can be prevented.

Figure 15:
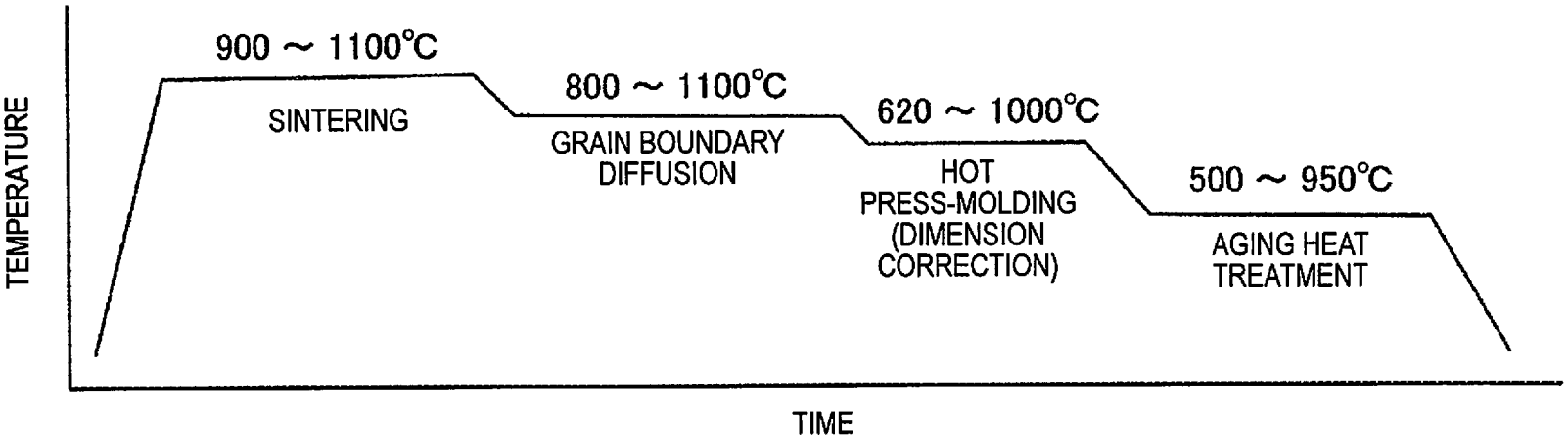
FIG. 15 is a graph showing temperature changes in a case of carrying out the sintered magnet manufacturing method according to a modification example of the fifth embodiment of the present invention.

FIG. 15 is a graph showing temperature changes in a case of carrying out the sintered magnet manufacturing method according to a modification example of the fifth embodiment of the present invention. As shown in FIG. 15, after carrying out the sintering step at 900° C.-1,100° C. in order to bring the containment vessel 20 interior to a heated atmosphere when carrying out the grain boundary diffusion step, the grain boundary diffusion step is carried out at 800° C.-1,100° C. The dimension correction step may then be carried out at 620° C.-1,000° C., and aging heat treatment carried out at 500° C.-950° C. As shown in FIG. 15, by carrying out the grain boundary diffusion step, a decline in magnet characteristics such as retention force can be prevented, a dimension correction of the sintered magnet can be accomplished at a good yield ratio of material, thermal energy losses and production lead times may be reduced, and deformation of structures forming the manufacturing apparatus is less likely to occur.

The present invention is not limited only to the embodiments shown above, and various modifications are possible within the scope set forth in the claims.

FIGS. 13A-E are schematic views showing a modification example of the second or fourth embodiment of the present invention. Whereas the second and fourth embodiments described a case in which, subsequent to dimension correction, the sintered magnet is released from the molds 212, 213, 214, then transported to the heat treatment chamber 300 and the cooling chamber 400, it would be acceptable to transport [the sintered magnet] the heat treatment chamber 300 and the cooling chamber 400, and carry out aging heat treatment and the cooling step, without first releasing it from the molds 212, 213, 214.

Test Example 1

Next, tests relating to molding temperature during press machining carried out at the time of the dimension correction process in the sintered magnet manufacturing method according to the present embodiment are described.

For the test, as sintered magnet test pieces (3.8 mm in thickness, cross sectional length of 6 mm×6 mm), magnet test pieces were secured by employing the upper slide, bolster, and outside peripheral mold in the same manner as in FIG. 4, the temperature was raised from room temperature while applying pressure, and the amount of deformation of the samples was measured. The metal of the sintered magnet according to Test Example 1 was formed of Fe 70%, Nd 22%, B 0.4%, Dy 2.5%, and Pr 2.5%. Table 1 is a table showing the deformation rate (%) and the molding temperature in the case of heating and applying pressure to the sintered magnet test pieces of Test Example 1, and FIG. 11 is a graph of Table 1. The molding temperature was measured by placing a thermocouple in contact with a side face of the magnet test piece when applying pressure.

TABLE 1

| Temp (° C.) | Yield stress (MPa) | Deformation amt. (mm) | Deformation rate (%) |
|---|---|---|---|
| 25 | 1019 | 0 | 0 |
| 200 | 1187 | 0 | 0 |
| 300 | 1108 | 0 | 0 |
| 400 | 775.5 | 0 | 0 |
| 500 | 442.0 | 0 | 0 |
| 600 | 308.8 | 0 | 0 |
| 610 | 295.2 | 0 | 0 |
| 620 | 262.5 | 0.0488 | 1.28 |
| 630 | 244.9 | 0.3662 | 9.64 |
| 650 | 248.3 | 0.5274 | 13.88 |
| 700 | 229.6 | 0.4785 | 12.59 |
| 750 | 188.3 | 0.5567 | 14.65 |
| 800 | 150.5 | 0.4785 | 12.59 |
| 850 | 174.2 | 0.6445 | 16.96 |
| 950 | 152.8 | 1.0010 | 26.34 |
| 1050 | 36.14 | 1.4991 | 39.45 |

From Table 1 and FIG. 11, it may be appreciated that the R—Fe—B based sintered magnet according to Test Example 1 gave rise to plastic deformation starting from 620 degrees. This means that dimension correction of the sintered magnet through press machining may be carried out when the temperature is 620° C. or above; the sintering temperature of the aforementioned R—Fe—B based sintered magnet is 1,000° C. When the molding temperature is 620° C. or above but also exceeds the sintering temperature, changes are produced in the texture and magnet characteristics of the sintered magnet, and it was therefore found to be preferable to carry out the dimension correction step according the present embodiment within a range of 620° C. to 1,000° C., which does not exceed the sintering temperature. It was also found from Table 1 that, in this case, the yield strain at which the magnet plastically deforms when carrying out press machining on the magnet is 36 MPa-262 MPa.

The invention claimed is:

1. A method for manufacturing a sintered magnet, comprising:

molding a green compact formed by compacting a magnet powder by press-molding the magnet powder, the green compact forming an R—Fe—B based sintered magnet containing Nd and at least one additional rare earth element as the component R and having a main phase of Nd—Fe—B;

sintering the green compact by heating to a sintering temperature, so as to mold a sintered magnet;

pressure molding the sintered magnet in a mold by heating to a temperature not exceeding the sintering temperature, so as to correct dimensions of the sintered magnet; and adjusting the texture of the sintered magnet by aging heat treatment using a heated atmosphere produced during the pressure molding, the aging heat treatment being performed at a lower temperature than a temperature used during the pressure molding, the lower temperature ranging from 500° C. to 950° C., and the aging treatment being performed in a same containment vessel as the pressure molding with the mold maintained in a same position as during the pressure molding.

2. The method for manufacturing a sintered magnet according to claim 1, wherein the sintering includes producing the heated atmosphere, and the dimensions of the sintered magnet are corrected by utilizing the heated atmosphere produced in the sintering.

3. The method for manufacturing a sintered magnet according to claim 1, wherein at least one of the sintering, the pressure molding and the adjusting the texture of the sintered magnet by aging heat treatment is carried out in an atmosphere subjected to a non-oxidizing treatment.

4. The method for manufacturing a sintered magnet according to claim 1, further comprising performing grain boundary diffusion on the sintered magnet between the pressure molding and the adjusting the texture of the sintered magnet by the aging heat treatment.

5. The method for manufacturing a sintered magnet according to claim 1, further comprising performing grain boundary diffusion on the sintered magnet between the sintering and the pressure molding.

6. The method for manufacturing a sintered magnet according to claim 1, wherein in the pressure molding, the sintered magnet is heated to 620° C. or above.

7. The method for manufacturing a sintered magnet according to claim 1, wherein in the pressure molding, the sintered magnet is heated to 800° C. or below.

8. The method for manufacturing a sintered magnet according to claim 2, wherein at least one of the sintering, the pressure molding and the adjusting the texture of the sintered magnet by aging heat treatment is carried out in an atmosphere subjected to a non-oxidizing treatment.

9. The method for manufacturing a sintered magnet according to claim 2, further comprising performing grain boundary diffusion on the sintered magnet between the pressure molding and the adjusting the texture of the sintered magnet by the aging heat treatment.

10. The method for manufacturing a sintered magnet according to claim 3, further comprising performing grain boundary diffusion on the sintered magnet between the pressure molding and the adjusting the texture of the sintered magnet by the aging heat treatment.

11. The method for manufacturing a sintered magnet according to claim 2, further comprising performing grain boundary diffusion on the sintered magnet between the sintering and the pressure molding.

12. The method for manufacturing a sintered magnet according to claim 2, further comprising performing grain boundary diffusion on the sintered magnet between the sintering and the pressure molding.

13. The method for manufacturing a sintered magnet according to claim 2, wherein in the pressure molding, the sintered magnet is heated to 620° C. or above.

14. The method for manufacturing a sintered magnet according to claim 3, wherein in the pressure molding, the sintered magnet is heated to 620° C. or above.

15. The method for manufacturing a sintered magnet according to claim 4, wherein in the pressure molding, the sintered magnet is heated to 620° C. or above.

16. The method for manufacturing a sintered magnet according to claim 5, wherein in the pressure molding, the sintered magnet is heated to 620° C. or above.

17. The method for manufacturing a sintered magnet according to claim 3, wherein in the pressure molding, the sintered magnet is heated to 800° C. or below.

18. The method for manufacturing a sintered magnet according to claim 4, wherein in the pressure molding, the sintered magnet is heated to 800° C. or below.

19. The method for manufacturing a sintered magnet according to claim 5, wherein in the pressure molding, the sintered magnet is heated to 800° C. or below.

20. The method for manufacturing a sintered magnet according to claim 6, wherein in the pressure molding, the sintered magnet is heated to 800° C. or below.

* * * * *